US007845788B2

(12) United States Patent
Oku

(10) Patent No.: US 7,845,788 B2
(45) Date of Patent: Dec. 7, 2010

(54) IMAGE FORMING APPARATUS AND METHOD

(75) Inventor: Seiichiro Oku, Kanagawa-ken (JP)

(73) Assignee: FujiFilm Corporation, Tokyo (JP)

( * ) Notice: Subject to any disclaimer, the term of this patent is extended or adjusted under 35 U.S.C. 154(b) by 580 days.

(21) Appl. No.: 11/892,481

(22) Filed: Aug. 23, 2007

(65) Prior Publication Data

US 2008/0050140 A1 Feb. 28, 2008

(30) Foreign Application Priority Data

Aug. 28, 2006 (JP) ..... 2006-230933

(51) Int. Cl.
*B41J 2/01* (2006.01)
*B41J 2/325* (2006.01)
*B41J 31/00* (2006.01)

(52) U.S. Cl. ..... 347/103; 347/17; 347/19; 347/101; 347/213

(58) Field of Classification Search ..... 347/17, 347/19, 101, 103, 213
See application file for complete search history.

(56) References Cited

U.S. PATENT DOCUMENTS 6,820,975 B2 * 11/2004 Sugaya et al. ..... 347/104
6,911,993 B2 * 6/2005 Nishikawa et al. ..... 347/116
7,264,328 B2 * 9/2007 Folkins et al. ..... 347/19
2006/0066657 A1 * 3/2006 Folkins et al. ..... 347/19

FOREIGN PATENT DOCUMENTS

EP 0519710 A2 12/1992
JP 5-181341 A 7/1993
JP 7-234556 A 9/1995

* cited by examiner

*Primary Examiner*—Ryan Lepisto
(74) *Attorney, Agent, or Firm*—Birch, Stewart, Kolasch & Birch, LLP

(57) ABSTRACT

The image forming apparatus includes: a head which ejects ink droplets; an intermediate transfer body having a transfer surface on which a transfer image is formed by means of the ink droplets ejected from the head; a transfer device which performs transfer of the transfer image formed on the transfer surface of the intermediate transfer body to a prescribed transfer-receiving medium; a transfer surface reading device which obtains read image data by reading in the transfer surface of the intermediate transfer body after the transfer; a judgment device which performs judgment of a transfer state of the transfer surface of the intermediate transfer body in accordance with the read image data obtained by the transfer surface reading device; and a transfer condition changing device which changes a transfer condition of the transfer device in accordance with the judgment of the judgment device.

12 Claims, 7 Drawing Sheets

IMAGE FORMING APPARATUS AND METHOD

BACKGROUND OF THE INVENTION

1. Field of the Invention

The present invention relates to an image forming apparatus and an image forming method which form a transfer image on an intermediate transfer body and transfer same to a transfer-receiving medium, such as paper.

2. Description of the Related Art

An image forming apparatus has been proposed in which, after forming a transfer image on an intermediate transfer body, the transfer image formed on the intermediate transfer body is then transferred to a transfer-receiving medium, such as paper.

An electrophotographic process which transfers electrically charged toner is widely known as a transfer process technology. In an electrophotographic process of this kind, toner is deposited on and removed from the intermediate transfer body by controlling the charging of dry powder (toner). Consequently, it is possible to remove the toner relatively easily, with 100% efficiency, and furthermore, there is little effect on the next print even if the transfer efficiency varies.

Japanese Patent Application Publication No. 5-181341 discloses an image forming apparatus constituted of: a transfer device which transfers a toner image on an image bearing member, formed by a developing device, onto a transfer member; a detection pattern image forming device which forms a predetermined pattern image for detection on the image bearing member; a detection pattern state detecting device, disposed opposing the image bearing member at downstream of the transfer device, for detecting the state of the detection pattern; and a controller which controls an image forming condition of the image forming apparatus in accordance with a detection by the detection pattern state detecting device.

Japanese Patent Application Publication No. 7-234556 discloses an image forming apparatus constituted of: a determination device which determines the state of an image formed on a photosensitive body; an intermediate transfer body onto which developer on the photosensitive body is transferred; and a fixing apparatus which fixes the developer on transfer paper to which the developer is transferred from the intermediate transfer body, wherein the determination device is disposed on the downstream side of the transfer position of the photosensitive body.

However, in an inkjet type of image forming apparatus, droplets of liquid ink are deposited onto an intermediate transfer body, and the coloring material in the ink is then transferred onto a transfer-receiving medium, such as paper, and consequently, the transfer efficiency of the coloring material is liable to vary, and fluctuation in the image quality occurs due to this variation in the transfer efficiency of the coloring material. In other words, when the intermediate transfer body is repeatedly used, the residual ink after transfer has an adverse effect on the next and subsequent prints, thereby leading to a decline in image quality.

It is possible to provide a cleaning device that cleans the intermediate transfer body after transfer; however, the cleaning properties of the cleaning device itself decline and the cleaning efficiency varies, and therefore it is not possible to prevent decline in image quality as a result of residual ink.

SUMMARY OF THE INVENTION

The present invention has been contrived in view of these circumstances, an object thereof being to provide an image forming apparatus and an image forming method whereby, even if an intermediate transfer body is used repeatedly, the effects on the next and subsequent prints caused by residual ink after transfer can be prevented, and image quality can be maintained.

In order to attain the aforementioned object, the present invention is directed to an image forming apparatus, comprising: a head which ejects ink droplets; an intermediate transfer body having a transfer surface on which a transfer image is formed by means of the ink droplets ejected from the head; a transfer device which performs transfer of the transfer image formed on the transfer surface of the intermediate transfer body to a prescribed transfer-receiving medium; a transfer surface reading device which obtains read image data by reading in the transfer surface of the intermediate transfer body after the transfer; a judgment device which performs judgment of a transfer state of the transfer surface of the intermediate transfer body in accordance with the read image data obtained by the transfer surface reading device; and a transfer condition changing device which changes a transfer condition of the transfer device in accordance with the judgment of the judgment device.

According to this aspect of the present invention, since the transfer surface of the intermediate transfer body after the transfer is read by the transfer surface reading device, the transfer state of the transfer surface of the intermediate transfer body is judged by the judgment device, and the transfer condition of the transfer device is changed by the transfer condition changing device on the basis of this judgment result, then even if the intermediate transfer body is used repeatedly, it is possible to maintain image quality by preventing effects caused to the next and subsequent prints by residual ink after the transfer.

Preferably, the transfer condition changed by the transfer condition changing device includes at least one of: a pressure with which the transfer-receiving medium is pressed against the transfer surface of the intermediate transfer body by the transfer device, duration during which the transfer-receiving medium is pressed against the transfer surface of the intermediate transfer body by the transfer device, and a temperature during the transfer performed by the transfer device.

Preferably, the judgment device performs the judgment of the transfer state of the transfer surface of the intermediate transfer body in accordance with a correlation between image data used for image formation onto the transfer surface of the intermediate transfer body by the head, and the read image data obtained by the transfer surface reading device.

In order to attain the aforementioned object, the present invention is also directed to an image forming apparatus, comprising: a head which ejects ink droplets; an intermediate transfer body having a transfer surface on which a transfer image is formed by means of the ink droplets ejected from the head; a transfer device which performs transfer of the transfer image formed on the transfer surface of the intermediate transfer body to a prescribed transfer-receiving medium; a cleaning device which performs cleaning of the transfer surface of the intermediate transfer body after the transfer; a transfer surface reading device which obtains read image data by reading in the transfer surface of the intermediate transfer body after the transfer; a judgment device which performs judgment of a cleaning state of the transfer surface of the intermediate transfer body in accordance with the read image data obtained by the transfer surface reading device; and a cleaning condition changing device which changes a cleaning condition of the cleaning device in accordance with the judgment of the judgment device.

According to this aspect of the present invention, since the transfer surface of the intermediate transfer body after the transfer is read by the transfer surface reading device, the cleaning state of the transfer surface of the intermediate transfer body is judged by the judgment device, and the cleaning condition of the cleaning device is changed by the cleaning condition changing device on the basis of this judgment result, then even if the intermediate transfer body is used repeatedly, it is possible to maintain image quality by preventing effects caused to the next and subsequent prints by residual ink after transfer.

Preferably, the cleaning condition changed by the cleaning condition changing device includes at least one of: a pressure with which the cleaning device is pressed against the transfer surface of the intermediate transfer body, duration of the cleaning performed by the cleaning device, and a temperature during the cleaning performed by the cleaning device.

Preferably, the judgment device performs the judgment of the cleaning state of the transfer surface of the intermediate transfer body in accordance with a correlation between image data used for image formation onto the transfer surface of the intermediate transfer body by the head, and the read image data obtained by the transfer surface reading device.

In order to attain the aforementioned object, the present invention is also directed to an image forming method, comprising: a transfer image forming step of forming a transfer image on a prescribed transfer surface by depositing ink droplets onto the transfer surface; a transfer step of transferring the transfer image formed on the transfer surface to a prescribed transfer-receiving medium; a transfer surface reading step of obtaining read image data by reading in the transfer surface after the transfer step; a judgment step of performing judgment of a transfer state of the transfer surface in accordance with the read image data obtained in the transfer surface reading step; and a transfer condition changing step of changing a transfer condition in the transfer step in accordance with the judgment in the judgment step.

Preferably, the transfer condition changed in the transfer condition changing step includes at least one of: a pressure with which the transfer-receiving medium is pressed against the transfer surface in the transfer step, duration during which the transfer-receiving medium is pressed against the transfer surface in the transfer step, and a temperature during the transfer in the transfer step.

Preferably, the judgment in the judgment step is performed in accordance with a correlation between image data used for forming the transfer image in the transfer image forming step, and the read image obtained in the transfer surface reading step.

In order to attain the aforementioned object, the present invention is also directed to an image forming method, comprising: a transfer image forming step of forming a transfer image on a prescribed transfer surface by depositing ink droplets onto the transfer surface; a transfer step of transferring the transfer image formed on the transfer surface to a prescribed transfer-receiving medium; a cleaning step of cleaning the transfer surface after the transferring step; a transfer surface reading step of obtaining read image data by reading in the transfer surface after the cleaning step; a judgment step of performing judgment of a cleaning state of the transfer surface in accordance with the read image data obtained in the transfer surface reading step; and a cleaning condition changing step of changing a cleaning condition in the cleaning step in accordance with the judgment in the judgment step.

Preferably, the cleaning condition changed in the cleaning condition changing step includes at least one of: a pressure with which a cleaning unit that cleans the transfer surface is pressed against the transfer surface in the cleaning step, duration of the cleaning in the cleaning step, and a temperature during the cleaning in the cleaning step.

Preferably, the judgment in the judgment step is performed in accordance with a correlation between image data used for forming the transfer image in the transfer image forming step, and the read image obtained in the transfer surface reading step.

According to the present invention, even if the intermediate transfer body is used repeatedly, it is possible to maintain image quality by preventing effects caused to the next and subsequent prints by residual ink after the transfer.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
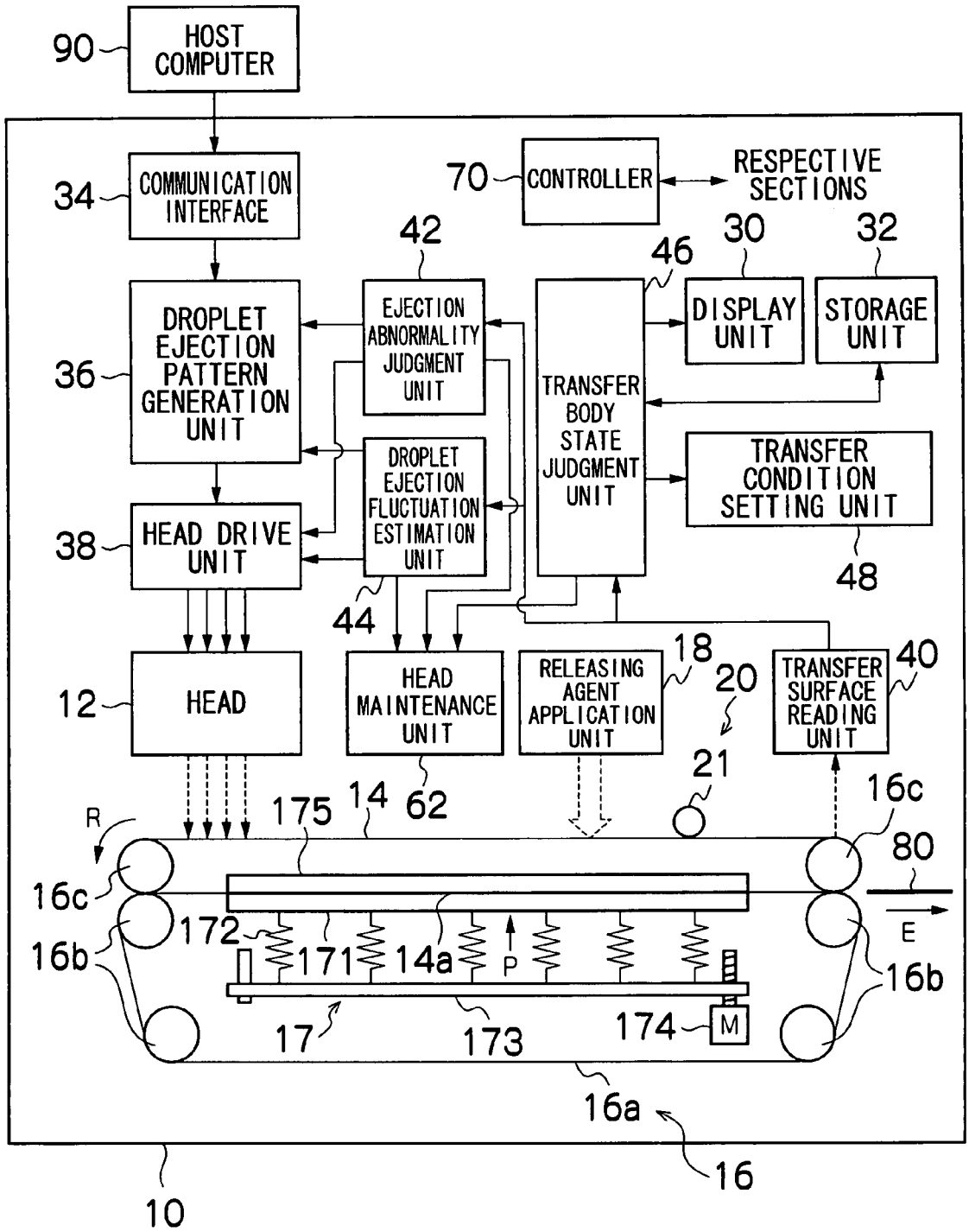
FIG. 1 is a schematic drawing showing the general composition of an image forming apparatus according to a first embodiment of the present invention.

FIG. 1 is a general schematic drawing showing the general composition of an image forming apparatus 10 according to a first embodiment of the present invention.

As shown in FIG. 1, the image forming apparatus 10 according to the first embodiment includes: a head 12, which ejects droplets of ink containing coloring material; an intermediate transfer body 14 having a transfer surface 14*a*, on which a transfer image is formed of the ink droplets ejected from the head 12; a transfer unit 16, which transfers the transfer image formed on the transfer surface 14*a* of the intermediate transfer body 14 onto a transfer-receiving medium 80, such as paper; an intermediate transfer body pressing unit 17; a releasing agent application unit 18 for applying a releasing agent, which facilitates the separation of the ink from the transfer surface 14*a* of the intermediate transfer body 14, onto the transfer surface 14*a* of the intermediate transfer body 14; and a cleaning unit 20, which cleans the transfer surface 14*a* of the intermediate transfer body 14.

The head 12 has a plurality of nozzles 51 described later with reference to FIGS. 2 and 3, and forms a transfer image on the transfer surface 14*a* of the intermediate transfer body 14 by ejecting and depositing droplets of ink onto the transfer surface 14*a* of the intermediate transfer body 14 from these nozzles 51.

In the present embodiment, the intermediate transfer body 14 is constituted of an endless belt (hereinafter referred to as an "upper belt") and rotates repeatedly in the direction of rotation indicated by an arrow R in FIG. 1. The outer circumferential surface of the intermediate transfer body 14 forms the transfer surface 14*a*, and the transfer image is formed by deposition of the ink droplets ejected from the head 12, at a position on the transfer surface 14*a* opposing the head 12.

In the present invention, the intermediate transfer body 14 is not limited in particular to an endless belt such as that shown in FIG. 1, and it is also possible that the intermediate transfer body 14 is constituted of a round cylindrical shaped body, such as a drum, for example.

The transfer unit 16 conveys the transfer-receiving medium 80 in conjunction with the motion of the intermediate transfer body 14, as well as pressing the transfer-receiving medium 80 against the transfer surface 14*a* of the intermediate transfer body 14, thereby transferring the transfer image on the transfer surface 14*a* of the intermediate transfer body 14 to the transfer-receiving medium 80.

In the embodiment shown in FIG. 1, the transfer unit 16 is constituted of: an endless belt 16*a* (hereinafter referred to as a "lower belt"), which rotates while making contact with the transfer surface 14*a* of the intermediate transfer body 14; a set of rollers 16*b* (hereinafter referred to as "lower rollers"), about which the lower belt 16*a* is wound; and a pair of rollers 16*c* (hereinafter referred to as "upper rollers"), about which the intermediate transfer body 14 is wound. Due to the rotation of the upper rollers 16*c* and the lower rollers 16*b*, the intermediate transfer body 14 (the upper belt) and the lower belt 16*a*, which abuts against the transfer surface 14*a* of the intermediate transfer body 14, are caused to rotate.

The intermediate transfer body pressing unit 17 presses the transfer-receiving medium 80 against the transfer surface 14*a* of the intermediate transfer body 14 by pressing the lower belt 16*a* in the pressing direction indicated by arrow P in FIG. 1 (toward the side where the intermediate transfer body 14 is disposed).

The intermediate transfer body pressing unit 17 is constituted of: a pressing plate 171, which presses the lower belt 16*a* at the position opposing the intermediate transfer body 14, toward the side of the intermediate transfer body 14; a pushing member or a spring 172, which is disposed between the pressing plate 171 and a supporting member 173; a motor 174, which moves the position of the supporting member 173 in the direction of the arrow P (the vertical direction in FIG. 1); and a back plate 175, which faces the pressing plate 171 across the intermediate transfer body 14 and supports the intermediate transfer body 14 from the rear surface (the surface reverse to the transfer surface 14*a*).

When the position of the supporting member 173 in the pressing direction P is changed by means of the motor 174, the interval between the pressing plate 171 and the supporting member 173 is altered and the pressing force with which the lower belt 16*a* is pressed against the intermediate transfer body 14 by the pressing plate 171 is changed.

In this way, by changing the pressing force of the lower belt 16*a* in the pressing direction P, the pressure (hereinafter referred to as the "transfer pressure") with which the transfer-receiving medium 80 is pressed against the transfer surface 14*a* of the intermediate transfer body 14 is changed. Moreover, by changing the rotational speed of the upper rollers 16*c* and the lower rollers 16*b*, the transfer speed of the transfer-receiving medium 80 is changed, and consequently, the duration (hereinafter referred to as the "transfer duration") during which the transfer-receiving medium 80 is pressed against the transfer surface 14*a* of the intermediate transfer body 14 is changed. Furthermore, by changing the temperature of at least the region (the "transfer image region") on the transfer surface 14*a* of the intermediate transfer body 14 where the transfer image is formed, the temperature (hereinafter referred to as the "transfer temperature") during the transfer is changed.

The transfer-receiving medium 80 is conveyed from left to right in FIG. 1 while being pressed between the intermediate transfer body 14 (the upper belt) and the lower belt 16*a* of the transfer unit 16, thereby transferring the transfer image by means of the transfer unit 16, and it is then outputted in the output direction indicated by an arrow E in FIG. 1.

The releasing agent application unit 18 is disposed at the upstream side of the head 12 in terms of the rotation direction R of the intermediate transfer body 14, and it applies a releasing agent composed of liquid or powder, onto the transfer surface 14*a* of the intermediate transfer body 14, before the deposition of ink droplets by the head 12. By applying a releasing agent of this kind, efficient transfer of the transfer image can be achieved.

The cleaning unit 20 cleans the transfer surface 14*a* of the intermediate transfer body 14 after transfer.

In the present embodiment, the cleaning unit 20 is constituted of a roller 21 (hereinafter referred to as a "cleaning roller"), which abuts against the transfer surface 14*a* of the intermediate transfer body 14. The outer circumferential surface of the cleaning roller 21 is formed of a porous member, such as a sponge. By making the cleaning roller 21 idly rotate against the intermediate transfer body 14, while pressing the outer circumferential surface of the cleaning roller 21 against the transfer surface 14*a* of the intermediate transfer body 14, the transfer surface 14*a* of the intermediate transfer body 14 is cleaned. In other words, the ink is removed from the transfer surface 14*a* of the intermediate transfer body 14. Here, although not illustrated in the drawings, if suctioning by means of a pump is also used, then the ink can be removed even more effectively.

It is also possible to perform cleaning by pressing a blade or a brush against the transfer surface 14*a* of the intermediate transfer body 14, instead of the cleaning roller 21. Moreover, it is also possible to carry out washing by means of a liquid, such as water, and to perform drying after the washing process.

The image forming apparatus 10 further includes: a display unit 30, which performs various displays; a storage unit 32, which stores data of various kinds; a communication interface 34, which acquires image data (input image data) by means of communication with a host computer 90; a droplet ejection pattern generation unit 36, which generates droplet ejection pattern data relating to the ejection of ink droplets from the head 12, on the basis of the input image data acquired by the communication interface 34; a head drive unit 38, which drives the head 12 on the basis of the droplet ejection pattern data generated by the droplet ejection pattern generation unit 36; a transfer surface reading unit 40, which acquires read image data by reading in the transfer surface 14*a* of the intermediate transfer body 14; an ejection abnormality judgment unit 42, which judges ejection abnormalities in the head 12 on the basis of the read image data; a droplet ejection fluctuation estimation unit 44, which estimates droplet ejection fluctuation of the head 12 on the basis of the read image data; a transfer body state judgment unit 46, which judges the state of the transfer surface 14*a* of the intermediate transfer body 14 on the basis of the read image data; a transfer condition setting unit 48, which sets transfer conditions for the transfer unit 16; a head maintenance unit 62, which restores the droplet ejection state of the head 12 on the basis of the state of the transfer surface 14*a* of the intermediate transfer body 14, the ejection abnormality state and the droplet ejection fluctuation state; and a control unit 70, which controls the respective units of the image forming apparatus 10.

The display unit 30 is constituted of an LCD (liquid crystal display), for example.

The storage unit 32 is constituted of a RAM (random access memory), an EEPROM (electronically erasable and programmable ROM), or the like, for instance.

For the communication interface 34, a wired or wireless interface, such as a USB (universal serial bus), IEEE 1394, or the like, can be used. The communication interface 34 receives input image data transmitted by the host computer 90.

The droplet ejection pattern generation unit 36 generates droplet ejection pattern data required in order to form a transfer image on the transfer surface 14*a* of the intermediate transfer body 14. The droplet ejection pattern data indicates the presence or absence of droplet ejection, and the like, for each nozzle 51 (see FIG. 2) of the head 12.

The head drive unit 38 generates drive signals corresponding to the respective nozzles 51 of the head 12, on the basis of the droplet ejection pattern data, and supplies these drive signals to the head 12.

The transfer surface reading unit 40 is, for example, constituted of a light source and a light sensor, which are disposed opposing the transfer surface 14*a* of the intermediate transfer body 14, and acquires read image data by optically reading in the transfer surface 14*a* of the intermediate transfer body 14.

Moreover, it is also possible that the intermediate transfer body 14 is made, for example, of a material having light transmitting properties, and the transfer surface reading unit 40 is constituted of a light source and a light sensor that face to each other across the intermediate transfer body 14.

The light sensor constituting the transfer surface reading unit 40 may include a photoelectric transducing element, such as a CCD (charge-coupled device), or a CMOS (complementary metal oxide semiconductor), for instance. These photoelectric transducing devices may be constituted of a single photoreceptor element, or they may form a line sensor or an array sensor in which photoreceptor elements are arranged in a one-dimensional or two-dimensional configuration. As described later, the read image data obtained by the transfer surface reading unit 40 is used for judgment of ejection abnormalities by the ejection abnormality judgment unit 42, estimation of droplet ejection fluctuation by the droplet ejection fluctuation estimation unit 44, and judgment of the transfer state of the transfer surface 14*a* by the transfer body state judgment unit 46. Furthermore, the read image data can be used to judge the conveyance state of the transfer-receiving medium 80. The read image data can also be used to judge whether or not to start up maintenance of the head 12, the transfer unit 16, the cleaning unit 20, and the like.

The ejection abnormality judgment unit 42 judges ejection abnormalities, such as ejection failures, in respect of each nozzle 51 of the head 12, on the basis of the read image data obtained by the transfer surface read unit 40.

The droplet ejection fluctuation estimation unit 44 estimates the droplet ejection fluctuation, such as the fluctuation in the droplet ejection position or fluctuation in the ejection droplet size, for each nozzle 51 of the head 12, on the basis of the read image data obtained by the transfer surface read unit 40.

The transfer body state judgment unit 46 judges whether or not the transfer state of the transfer surface 14*a* of the intermediate transfer body 14 is satisfactory, on the basis of the read image data obtained by the transfer surface reading unit 40.

More specifically, the transfer body state judgment unit 46 judges whether or not the transfer state of the transfer surface 14*a* of the intermediate transfer body 14 is satisfactory by calculating the densities of the colors of cyan, magenta, and yellow in the region where the transfer image is formed (the transfer image region) on the transfer surface 14*a* of the intermediate transfer body 14, on the basis of the read image data, comparing the calculated densities with the base densities beforehand stored in the storage section 32, and then judging whether or not ink (the coloring material in the ink) is left remaining on the transfer surface 14*a* of the intermediate transfer body 14, accordingly. More specifically, if the calculated density is not higher than the base density, then the transfer state is judged to be satisfactory (normal), whereas if the calculated density is higher than the base density, then the transfer state is judged to be unsatisfactory.

Moreover, by cancelling out the noise component caused by non-uniformities in the transfer surface 14*a* itself, using the correlation between the read image data and the image data used to form the transfer image on the transfer surface 14*a* of the intermediate transfer body 14, it is possible to accurately and effectively judge the transfer state of the transfer surface 14*a* of the intermediate transfer body 14.

If there is ink (or the coloring material in the ink) left remaining on the transfer surface 14*a* of the intermediate transfer body 14, then the transfer body state judgment unit 46 determines the amount of residual ink (or coloring material in the ink), as well as judging, on the basis of the residual amount thus determined, whether or not action relating to the occurrence of a transfer error is required, in other words, whether or not it is necessary to change the transfer conditions, or to display a warning, or to carry out cleaning, or to halt printing, or the like.

It is also possible that the history of the residual amount of ink (or coloring material in the ink) is stored in the storage unit 32, and the state of degradation of the transfer surface 14*a* of the intermediate transfer body 14 is judged on the basis of this history in such a manner that the need or absence of need to replace the intermediate transfer body 14 can be accordingly determined. If it is judged by the transfer state judgment unit 46 that replacement of the intermediate transfer body 14 is necessary, then a message indicating the need to replace the intermediate transfer body 14 is displayed on the display unit 30.

The transfer condition setting unit 48 changes the transfer conditions of the transfer unit 16 on the basis of the transfer state of the transfer surface 14*a* of the intermediate transfer body 14 as judged by the transfer body state judgment unit 46.

The transfer conditions that can be changed by the transfer condition setting unit 48 include, for example, the transfer pressure, the transfer duration (or the transfer speed), the transfer temperature, and the like.

For example, the transfer condition setting unit 48 changes the pressing force with which the lower belt 16*a* constituting the transfer unit 16 is pressed in the direction indicated by the arrow P in FIG. 1, so that the pressure (transfer pressure) with which the transfer-receiving medium 80 is pressed against the transfer surface 14*a* of the intermediate transfer body 14 by the lower belt 16*a* is changed.

Moreover, for example, the transfer condition setting unit 48 changes the rotational speed of the upper rollers 16*c* and the lower rollers 16*b*, which constitute the transfer unit 16, so that the transfer speed (linear speed) of the transfer-receiving medium 80 is changed, and consequently, the duration (the transfer duration) during which the transfer-receiving medium 80 is pressed against the transfer surface 14*a* of the intermediate transfer body 14 is changed.

Furthermore, for example, the transfer condition setting unit 48 changes the temperature of the transfer surface 14*a* of the intermediate transfer body 14 in at least the region where the transfer image is formed (the transfer image region).

More specifically, if it is judged that the transfer state is unsatisfactory, then the transfer condition setting unit 48 changes the transfer conditions by, for example, increasing the transfer pressure, increasing the transfer duration (i.e., reducing the transfer speed), raising the transfer temperature, or the like, and thereby improves the transfer efficiency.

The transfer pressure is generally set to as low a pressure as possible, in order to prevent degradation of the intermediate transfer body 14, and degradation of the mechanism relating to the intermediate transfer body 14. The transfer speed is generally set to a high speed (in other words, the transfer duration is generally set to a short duration), thereby improving the print productivity under normal circumstances. The transfer temperature is generally set to as low a temperature as possible, in order to prevent degradation of the intermediate transfer body 14 and the mechanism relating to the intermediate transfer body 14.

The head maintenance unit 62 restores the state of the ink inside the head 12. For example, the head maintenance unit 62 is constituted of a blade (not illustrated) which cleans the ejection surface of the head 12 by sliding over the ejection surface of the head 12; a cap (not illustrated) which seals off the ejection surface of the head 12; a pump (not illustrated) which suctions the ink inside the head 12 through the cap; and a recovery tank (not illustrated) which recovers ink suctioned by the pump; and the like.

The control unit 70 implements various control processes for controlling: the formation of a transfer image on the transfer surface 14*a* of the intermediate transfer body 14 by means of the droplet ejection pattern generation unit 36, the head drive unit 38, the head 12, and the like; image transfer by means of the transfer unit 16; reading of the transfer surface by means of the transfer surface reading unit 40; judgment of the transfer state by means of the transfer body state judgment unit 46; changing of the transfer conditions by means of the transfer condition setting unit 48; cleaning of the transfer surface 14*a* of the intermediate transfer body 14 by means of the cleaning unit 20 (maintenance of the intermediate transfer body); control of ejection abnormality judgment by means of the ejection abnormality judgment unit 42 and the like; control of droplet ejection fluctuation estimation by means of the droplet ejection fluctuation estimation unit 44 and the like; head maintenance by means of the head maintenance unit 62; and so on.

It is possible that a single microcomputer serves as the control unit 70, the droplet ejection pattern generation unit 36, the ejection abnormality judgment unit 42, the droplet ejection fluctuation estimation unit 44, the transfer body state judgment unit 46 and the transfer condition setting unit 48.

Figure 2:
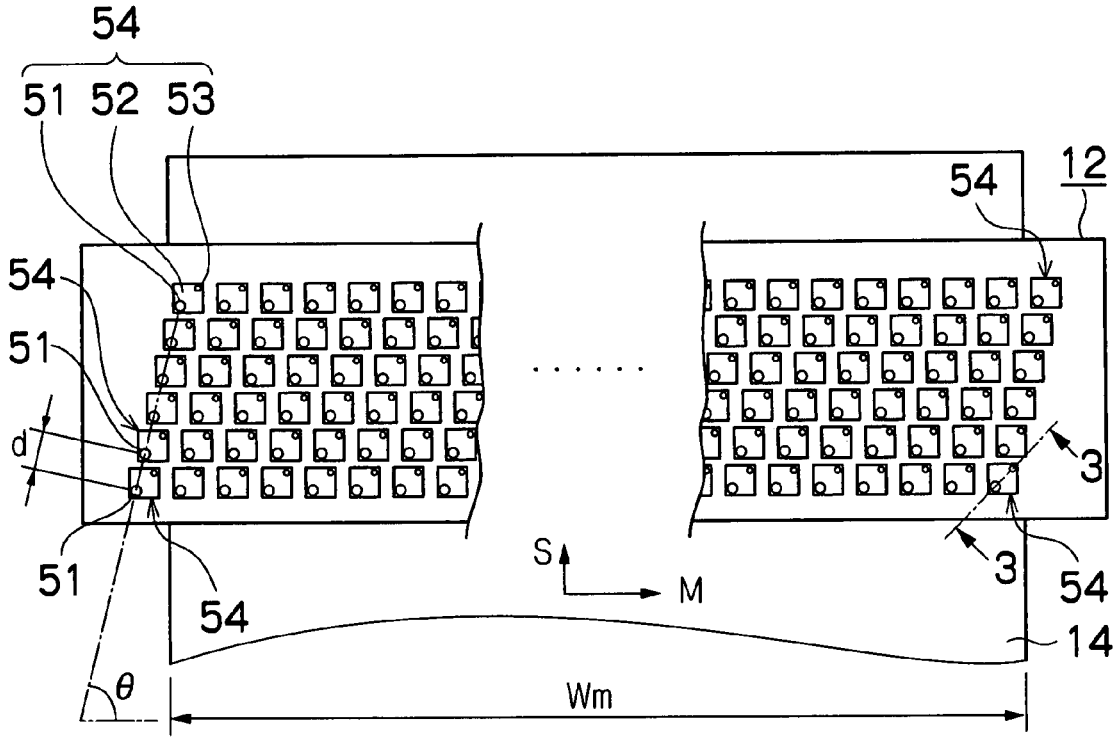
FIG. 2 is a plan view perspective diagram showing the general composition of an embodiment of a head.
Figure 3:
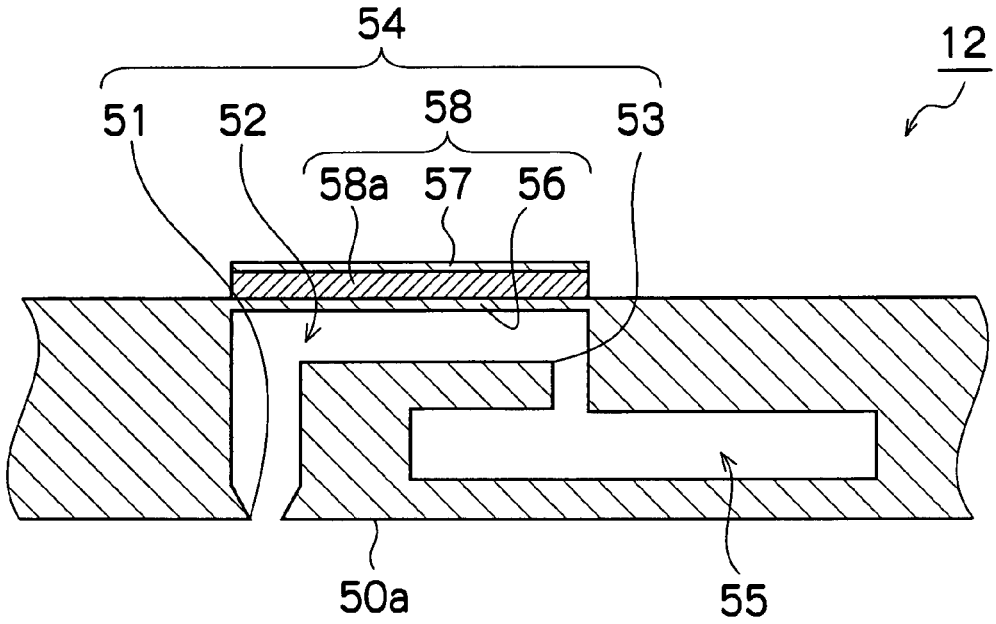
FIG. 3 is a cross-sectional diagram along line 3-3 in FIG. 2.

FIG. 2 is a plan view perspective diagram showing the general composition of an embodiment of the head 12 in FIG. 1; and FIG. 3 is a cross-sectional diagram along line 3-3 in FIG. 2.

The head 12 shown in FIG. 2 is a so-called full line head, having a structure in which the plurality of nozzles 51, which eject droplets of ink toward the intermediate transfer body 14, are arranged in a two-dimensional configuration through a length corresponding to the width Wm of the intermediate transfer body 14 in the direction perpendicular to the direction of relative movement of the intermediate transfer body 14 with respect to the head 12 (i.e., the sub-scanning direction indicated by an arrow S in FIG. 2), in other words, in the main scanning direction indicated by an arrow M in FIG. 2.

The head 12 has a plurality of pressure chamber units 54. Each of the pressure chamber units 54 has the nozzle 51, a pressure chamber 52 connected to the nozzle 51, and a liquid supply port 53. The ejection elements 54 are arranged in two directions, namely, the main scanning direction M and an oblique direction forming a prescribed acute angle θ ($0° < \theta < 90°$) with respect to the main scanning direction M. In FIG. 2, in order to simplify the drawing, only a portion of the ejection elements 54 are depicted in the drawing.

In specific terms, the nozzles 51 are arranged at a uniform pitch d in the direction forming the prescribed acute angle of θ with respect to the main scanning direction M, and hence the nozzle arrangement can be treated as equivalent to a configuration in which the nozzles are arranged at an interval of $d \times \cos\theta$ in a single straight line following the main scanning direction M.

FIG. 3 is a cross-sectional diagram along line 3-3 in FIG. 2, showing one of the ejection elements 54, which constitutes the head 12. In FIG. 3, only one ejection element 54 is depicted and therefore only one nozzle 51 is arranged on the liquid ejection surface 50*a*, but in actual practice, the plurality of ejection elements 54 are arranged two-dimensionally in the head 12, as shown in FIG. 2, and the plurality of nozzles 51 are arranged two-dimensionally in the liquid ejection surface 50*a*.

As shown in FIG. 3, each pressure chamber 52 is connected to a common liquid chamber 55 through the liquid supply port 53. The common liquid chamber 55 is connected to an ink tank (not illustrated) which serves as an ink source. In other words, the ink supplied from the ink tank is distributed and supplied to the respective pressure chambers 52 through the common liquid chamber 55.

A piezoelectric body 58*a* is disposed on a diaphragm 56, which constitutes the ceiling of the pressure chamber 52, and an individual electrode 57 is provided on the piezoelectric body 58*a*. The diaphragm 56 is earthed and also serves as a common electrode. A piezoelectric element 58 is constituted of the diaphragm 56, the individual electrode 57 and the piezoelectric body 58*a*, and serves as a device for generating pressure inside the pressure chamber 52.

When a drive voltage generated by the head drive unit 38 in FIG. 1 is applied to the piezoelectric element 58, the piezoelectric body 58*a* deforms, thereby changing the volume of the pressure chamber 52, and this results in a change in the pressure inside the pressure chamber 52, which causes the ink to be ejected (in the form of a droplet) from the nozzle 51. When an ink droplet has been ejected, new ink is supplied to the pressure chamber 52 from the common flow chamber 55, through the liquid supply port 53.

The ejection elements 54 shown in FIGS. 2 and 3 are simply one example, and are not limited in particular to cases such as these. For example, instead of disposing the common liquid chamber 55 below the pressure chamber 52 (in other words, a liquid ejection surface 50*a* side of the pressure chamber 52), it is also possible to dispose the common liquid chamber 55 above the pressure chamber 52 (in other words, on the side of the pressure chamber 52 reverse to the side adjacent to the liquid ejection surface 50*a*).

Figure 4:
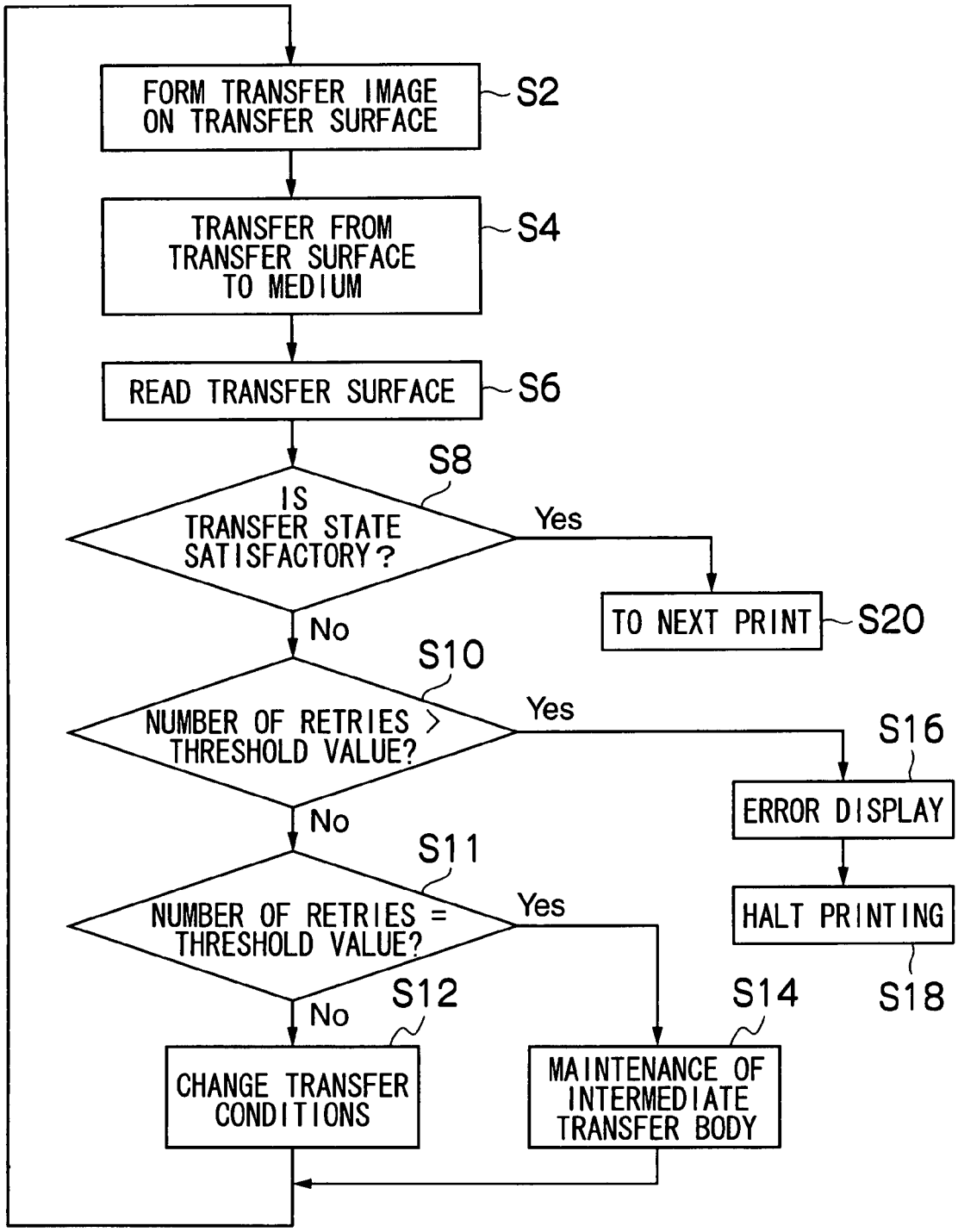
FIG. 4 is a flowchart showing a sequence of an image forming process according to the first embodiment.

FIG. 4 is a flowchart showing a general view of the sequence of an image forming process in the inkjet recording apparatus 10 according to the first embodiment of the present invention. This image forming process is carried out in accordance with a prescribed program, under the control of the control unit 70 in FIG. 1.

Droplet ejection pattern data is generated by the droplet ejection pattern generation unit 36 on the basis of the input image data acquired by the communication interface 34. By ejecting and depositing ink droplets from the head 12 onto the transfer surface 14*a* of the intermediate transfer body 14 by driving the head 12 by means of the head drive unit 38 on the basis of the droplet ejection pattern data, a transfer image is formed on the transfer surface 14*a* of the intermediate transfer body 14 (step S2).

The transfer-receiving medium 80, such as paper, is conveyed while being pressed between the intermediate transfer body 14 (the upper belt) and the lower belt 16*a*, which constitutes the transfer unit 16. Here, by means of the transfer-receiving medium 80 being pressed in the pressing direction indicated by the arrow P in FIG. 1, by means of the lower belt 16*a*, the transfer image on the transfer surface 14*a* of the intermediate transfer body 14 is transferred to the transfer-receiving medium 80 (step S4). The transfer-receiving medium 80 onto which the transfer image has been transferred is outputted in the output direction indicated by the arrow E in FIG. 1.

After the transfer, the transfer image region of the transfer surface 14*a* of the intermediate transfer body 14 is read in by the transfer surface reading unit 40, thereby generating read image data (step S6).

Thereupon, the transfer body state judgment unit 46 judges whether or not the transfer state of the transfer surface 14*a* of the intermediate transfer body 14 is satisfactory, on the basis of the read image data (step S8). More specifically, the transfer body state judgment unit 46 compares the densities of the colors cyan, magenta and yellow in the region where the transfer image is formed on the transfer surface 14*a* of the intermediate transfer body 14 (the transfer image forming region), with the base densities, which have been stored beforehand in the storage unit 32.

If the transfer of the transfer image from the transfer surface 14*a* of the intermediate transfer body 14 to the transfer-receiving medium 80 is sufficient and no ink is left on the transfer surface 14*a* of the intermediate transfer body 14 (in other words, in a satisfactory state where the density in the transfer image region is equal to or less than the base density), the next printing operation is carried out without changing the transfer conditions (step S20).

If it is judged in the step S8 that the transfer of the transfer image from the intermediate transfer body 14 to the transfer-receiving medium 80 is insufficient and the ink is left on the transfer surface 14*a* of the intermediate transfer body 14 and may cause adverse effects on the next print (in other words, in an unsatisfactory state where the density in the transfer image region is higher than the base density), it is then judged whether or not the number of retries is greater than a threshold value (step S10).

The following description relates to a case where the threshold value is set to "2", but the threshold value is not limited to being "2".

If the number of retries is equal to or less than the threshold value of "2", then the transfer conditions are changed (step S12), or maintenance of the intermediate transfer body 14 (step S14) is carried out, depending on the number of retries.

More specifically, it is judged whether or not the number of retries is equal to the threshold value "2" (step S11), and if the number of retries is less than the threshold value "2", in other words, if the number of retries is zero (the first print) or one (the first reprint), then the transfer conditions are changed (step S12). Thereupon, the steps of forming a transfer image (step S2), transferring the image (step S4), reading the transfer surface (step S6), and judging whether or not the transfer state is satisfactory (step S8), are carried out again, and if the state is satisfactory, then the next print is carried out (step S20).

The transfer conditions that can be changed include, for example, the transfer pressure, the transfer duration (or the transfer speed), and the transfer temperature. More specifically, it is possible to increase the transfer pressure, to increase the transfer duration (i.e., to reduce the transfer speed), or to raise the transfer temperature, or the like. By changing the transfer conditions in this way, the transfer efficiency is improved.

If the number of retries is equal to the threshold value, in other words, if the number of retries is two (the second reprint), then the maintenance of the intermediate transfer body 14 is carried out (step S14), whereupon the steps of forming a transfer image (step S2), transferring the image (step S4), reading the transfer surface (step S6), and judging whether or not the transfer state is satisfactory (step S8), are carried out again, and if the state is satisfactory, then the next print is carried out (step S20).

In the maintenance of the intermediate transfer body (step S14), the transfer surface 14*a* of the intermediate transfer body 14 is cleaned by the cleaning unit 20. In the present embodiment, the cleaning roller 21 is pressed against the transfer surface 14*a* of the intermediate transfer body 14 to perform cleaning. It is also possible to wash the transfer surface 14*a* of the intermediate transfer body 14 with a liquid, such as water.

If the change of the transfer conditions (step S12) or the maintenance of the intermediate transfer body 14 (step S14) is carried out, then it is possible to display a warning message requesting replacement of the intermediate transfer body 14, on the display unit 30. Furthermore, it is also possible to display a warning message requesting maintenance of the intermediate transfer body 14 when off line, on the display unit 30.

If the number of retries has exceeded the threshold value, in other words, if the transfer state has not become satisfactory even after changing the transfer conditions (step S12) and performing the maintenance of the intermediate transfer body 14 (step S14), then an error message is displayed (step S16), and the printing is halted (step S18). If, for example, the number of retries is three (the third reprint), then an error message indicating incomplete transfer is displayed on the display unit 30, and the printing is then halted.

In the judgment of the transfer state in the step S8, the density of the transfer surface 14*a* of the intermediate transfer body 14 that is compared to the base density is the density of the color of the ink in the transfer image region of the transfer surface 14*a* of the intermediate transfer body 14. There are various different modes for selecting the color in the printed image that is to be used for judgment. It can be judged that ink is left behind, if the density of any one of the colors obtained by reading the transfer surface 14*a* of the intermediate transfer body 14 is higher than the original density (the base density) of the transfer surface 14*a* of the intermediate transfer body 14. More specifically, the densities of the respective colors C (cyan), M (magenta) and Y (yellow) are determined from the read image data (RGB data), and for each of these three colors, the density is compared with the base density. Here, the color K (black) is not compared. If the black ink has a high density, then the densities of C, M and Y are also high, and therefore it is not necessary to measure and compare the black ink separately, alone.

Figure 5:
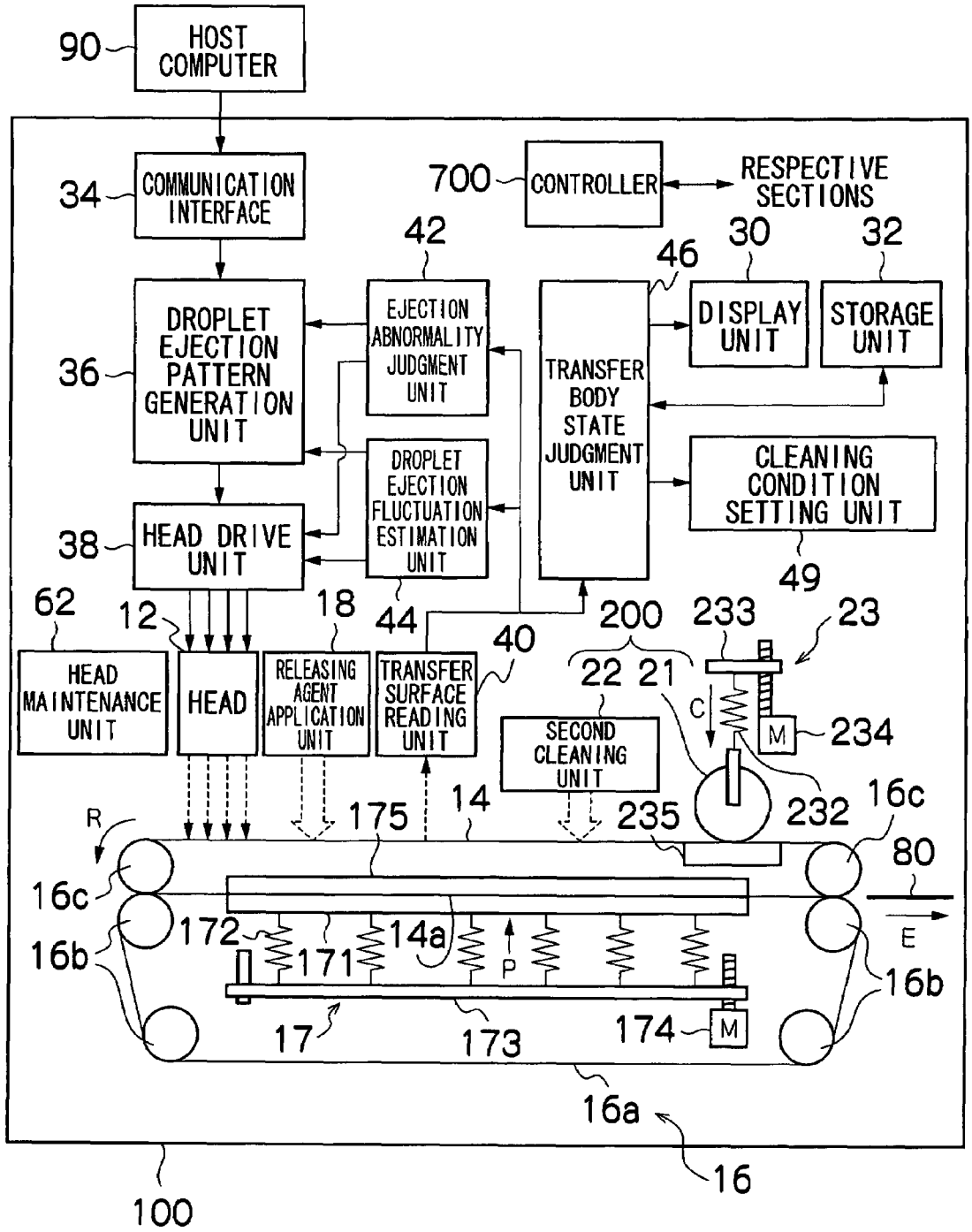
FIG. 5 is a schematic drawing showing the general composition of an image forming apparatus according to a second embodiment of the present invention.

FIG. 5 is a general schematic drawing showing the composition of an image forming apparatus 100 according to a second embodiment of the present invention.

As shown in FIG. 5, the image forming apparatus 100 according to the second embodiment includes: the head 12 (ink droplet ejection head), the intermediate transfer body 14, the transfer unit 16, the intermediate transfer body pressing unit 17, the releasing agent application unit 18, a cleaning roller pressing unit 23, a cleaning unit 200, the display unit 30, the storage unit 32, the communication interface 34, the droplet ejection pattern generation unit 36, the head drive unit 38, the transfer surface reading unit 40, the ejection abnormality judgment unit 42, the droplet ejection fluctuation estimation unit 44, the transfer body state judgment unit 46, a cleaning condition setting unit 49, the head maintenance unit 62 and a control unit 700.

The same reference numerals are assigned to constituent elements that are the same as those of the image forming apparatus 10 according to the first embodiment shown in FIG. 1, and description of details already explained in the first embodiment is omitted here.

The cleaning unit 200 according to the present embodiment is similar to the cleaning unit 20 according to the first embodiment in that it cleans the transfer surface 14*a* of the intermediate transfer body 14 after the transfer, and it differs from the cleaning unit 20 of the first embodiment in that it comprises a first cleaning unit 21 used in normal cleaning, and a second cleaning unit 22 used if the efficiency of normal cleaning has declined.

Moreover, the cleaning unit 200 according to the present embodiment is disposed to the upstream side from the transfer surface reading unit 40 in terms of the direction of rotation R of the intermediate transfer body 14. In other words, the transfer surface reading unit 40 is disposed to the downstream side of the cleaning unit 200 in terms of the direction of rotation R of the intermediate transfer body 14, in such a manner that the transfer surface reading unit 40 reads the transfer surface 14*a* of the intermediate transfer body 14 after cleaning.

In the present embodiment, the first cleaning unit 21 is constituted of the cleaning roller 21, which abuts against the transfer surface 14*a* of the intermediate transfer body 14. The cleaning roller 21 is the same as that described in the first embodiment, and description of the details already explained above is omitted here.

The cleaning roller pressing unit 23 presses the cleaning roller 21 against the transfer surface 14*a* of the intermediate transfer body 14 by pressing the cleaning roller 21 in the pressing direction indicated by an arrow C in FIG. 5.

The cleaning roller pressing unit 23 is constituted of: a spring 232, which is disposed between the cleaning roller 21 and a supporting member 233; a motor 234, which moves the position of the supporting member 233 in the pressing direction indicated by the arrow C (the vertical direction in FIG. 5); and a back plate 235, which faces the cleaning roller 21 across the intermediate transfer body 14 and supports the intermediate transfer body 14 from the rear surface.

When the position of the supporting member 233 in the pressing direction C is changed by means of the motor 234, the interval between the cleaning roller 21 and the supporting member 233 is altered and the pressing force with which the cleaning roller 21 is pressed against the transfer surface 14*a* of the intermediate transfer body 14 is changed.

In this way, it is possible to change the pressing force of the cleaning roller 21 in the pressing direction C (hereinafter referred to as the "cleaning pressure").

Moreover, by changing the rotational speed of the cleaning roller 21, the duration required for cleaning the transfer surface 14*a* of the intermediate transfer body 14 (hereinafter referred to as the "the cleaning duration") is changed. Furthermore, the temperature during cleaning (hereinafter referred to as the "cleaning temperature") can also be changed.

More beneficial effects are obtained by also using suctioning by means of a pump, which is not illustrated in the drawings. Furthermore, it is also possible to use a blade or a brush as the first cleaning unit 21, instead of the cleaning roller.

The second cleaning unit 22 is constituted of, for example: a washing device, which washes the transfer surface 14*a* of the intermediate transfer body 14 by means of a washing solution, such as water; and a drying device, which dries the transfer surface 14*a* of the intermediate transfer body 14 after the washing. In this way, it is possible that the second cleaning unit 22 is constituted of the device that requires a greater amount of time and materials for cleaning, compared to the first cleaning unit 21.

Although the above-described cleaning unit 200 is constituted of the first cleaning unit 21 and the second cleaning unit 22, it is possible to adopt a composition in which the second cleaning unit 22 is omitted.

The transfer body state judgment unit 46 judges whether or not the cleaning state of the transfer surface 14*a* of the intermediate transfer body 14 is satisfactory, on the basis of the read image data obtained by the transfer surface reading unit 40. The judgment of the cleaning state is similar to the judgment of the transfer state described with respect to the first embodiment.

More specifically, the transfer body state judgment unit 46 judges whether or not the cleaning state of the transfer surface 14*a* of the intermediate transfer body 14 is satisfactory by calculating the densities of the colors of cyan, magenta, and yellow in the transfer image region of the transfer surface 14*a* of the intermediate transfer body 14, on the basis of the read image data, comparing the calculated densities with the base densities beforehand stored in the storage section 32, and then judging whether or not ink is left remaining on the transfer surface 14*a* of the intermediate transfer body 14. More specifically, if the calculated density is not to higher than the base density, then the cleaning state is judged to be satisfactory (normal), whereas if the calculated density is higher than the base density, then the cleaning state is judged to be unsatisfactory. Furthermore, as described in the first embodiment, by cancelling out the noise component caused by non-uniformities in the transfer surface 14*a* itself, it is possible to accurately and efficiently judge the state of the transfer surface 14*a* of the intermediate transfer body 14.

The cleaning condition setting unit 49 sets the cleaning conditions of the cleaning unit 200, and changes the cleaning conditions of the cleaning unit 200 on the basis of the state of the transfer surface 14*a* of the intermediate transfer body 14 as judged by the transfer body state judgment unit 46.

The cleaning conditions that can be changed by the cleaning condition setting unit 49 include, for example, the cleaning pressure, the cleaning duration (or the cleaning speed), the cleaning temperature, and the like.

For example, the cleaning condition setting unit 49 changes the pressing force with which the cleaning roller 21 is pressed in the direction indicated by the arrow C in FIG. 5, in other words, the pressure with which the cleaning roller 21 is pressed against the transfer surface 14*a* of the intermediate transfer body 14 (the cleaning pressure).

Moreover, for example, the cleaning condition setting unit 49 changes the rotational speed of the cleaning roller 21, and consequently changes the duration (the cleaning duration) during which the transfer surface 14*a* of the intermediate transfer body 14 is cleaned by pressing the cleaning roller 21 against same.

Furthermore, for example, the cleaning condition setting unit 49 changes the temperature during the cleaning.

More specifically, if it is judged that the cleaning state is unsatisfactory, then the cleaning condition setting unit 49 changes the cleaning conditions by, for example, increasing the cleaning pressure, increasing the cleaning duration (i.e., reducing the cleaning speed), raising the cleaning temperature, or the like, thereby improves the cleaning efficiency and thus improves the transfer efficiency.

The cleaning pressure is generally set to as low a pressure as possible, in order to prevent degradation of the intermediate transfer body 14, and degradation of the mechanism relating to the intermediate transfer body 14. The cleaning speed is generally set to a high speed (in other words, the cleaning duration is generally set to a short duration). The cleaning temperature is generally set to as low a temperature as possible, in order to prevent deterioration of the intermediate transfer body 14 and the mechanism relating to the intermediate transfer body 14.

Moreover, in the present embodiment, even if the transfer efficiency and the cleaning efficiency have fallen, the cleaning condition setting unit 49 is able to implement cleaning by selecting an appropriate cleaning unit from the plurality of cleaning units 21 and 22, and therefore it is possible to restore the transfer surface 14*a* without causing a fall in productivity.

The control unit 700 implements various control processes for controlling: the formation of a transfer image on the transfer surface 14*a* of the intermediate transfer body 14 by means of the droplet ejection pattern generation unit 36, the head drive unit 38, the head 12, and the like; image transfer by means of the transfer unit 16; reading of the transfer surface by means of the transfer surface reading unit 40; judgment of the cleaning state by means of the transfer body state judgment unit 46; changing of the cleaning conditions by means of the cleaning condition setting unit 49; cleaning of the transfer surface 14*a* of the intermediate transfer body 14 by means of the cleaning unit 200; control of ejection abnormality judgment by means of the ejection abnormality judgment unit 42 and the like; control of droplet ejection fluctuation estimation by means of the droplet ejection fluctuation estimation unit 44 and the like; head maintenance by means of the head maintenance unit 62; and so on.

It is possible that a single microcomputer serves as the control unit 700, the droplet ejection pattern generation unit 36, the ejection abnormality judgment unit 42, the droplet ejection fluctuation estimation unit 44, the transfer body state judgment unit 46 and the cleaning condition setting unit 49.

Figure 6:
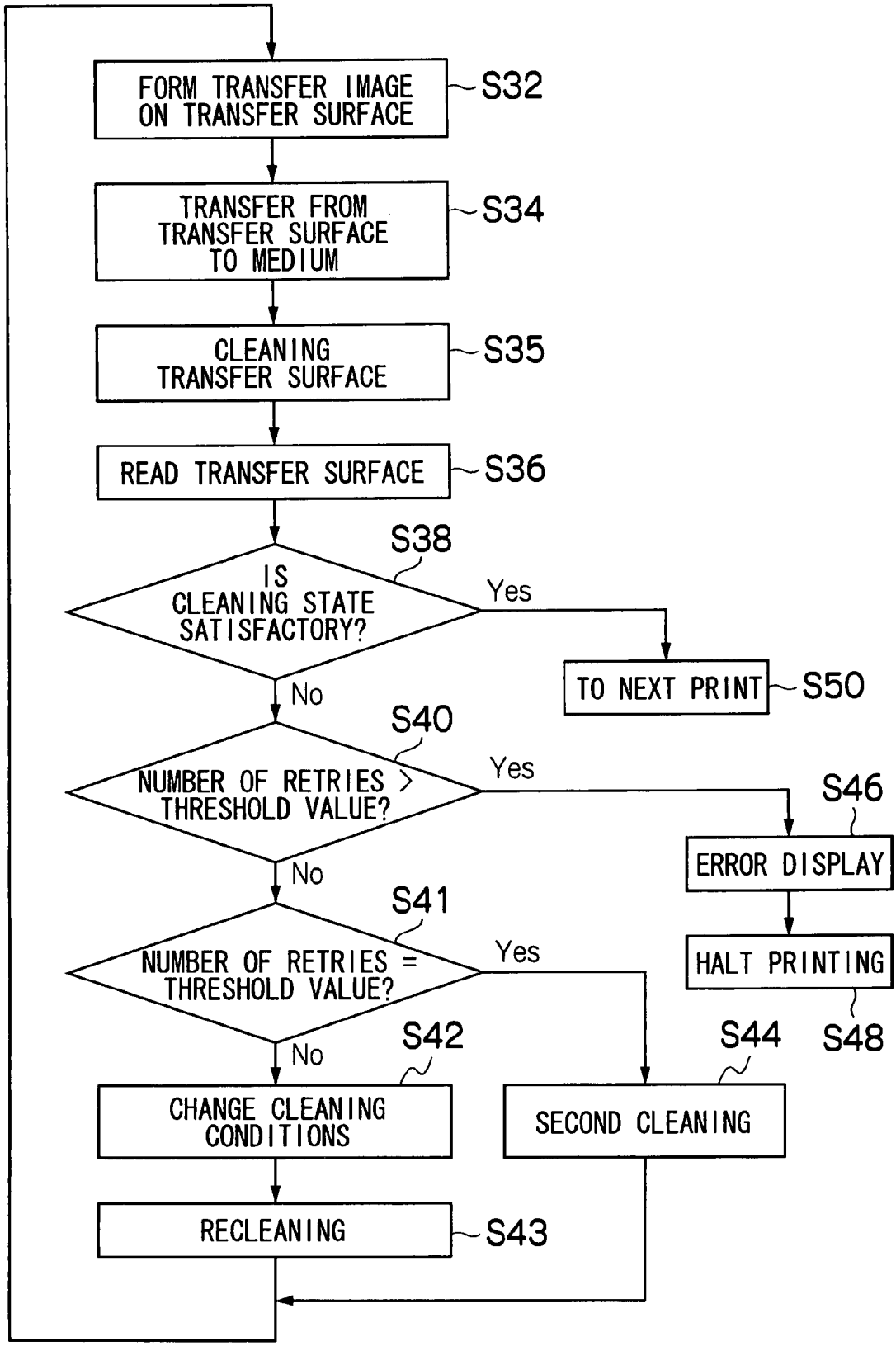
FIG. 6 is a flowchart showing a sequence of an image forming process according to the second embodiment.

FIG. 6 is a flowchart showing a general view of the sequence of an image forming process in the inkjet recording apparatus 100 according to the second embodiment of the present invention. This image forming process is carried out in accordance with a prescribed program, under the control of the control unit 700 in FIG. 5.

Firstly, ink droplets are ejected and deposited onto the transfer surface 14*a* of the intermediate transfer body 14 from the head 12 by driving the head 12 by means of the head drive unit 38, thereby forming a transfer image on the transfer surface 14*a* of the intermediate transfer body 14 (step S32).

The transfer image on the transfer surface 14*a* of the intermediate transfer body 14 is transferred to the transfer-receiving medium 80 (step S34). The transfer-receiving medium 80 onto which the transfer image has been transferred is outputted in the output direction indicated by the arrow E in FIG. 5.

After the transfer, the transfer surface 14*a* of the intermediate transfer body 14 is cleaned by the first cleaning unit 21 (step S35). More specifically, in FIG. 5, the region where the transfer image is formed on the transfer surface 14*a* of the intermediate transfer body 14 (the transfer image region) arrives at the first cleaning unit 21 and the ink is removed.

After the cleaning, the transfer image region of the transfer surface 14*a* of the intermediate transfer body 14 is read in by the transfer surface reading unit 40, thereby generating read image data (step S36).

Thereupon, the transfer body state judgment unit 46 judges whether or not the cleaning state of the transfer surface 14*a* of the intermediate transfer body 14 is satisfactory, on the basis of the read image data (step S38).

If the removal of the ink by the first cleaning unit 21 is sufficient, and no ink is left on the transfer surface 14*a* of the intermediate transfer body 14 (in other words, in a satisfactory state where the density in the transfer image region is equal to or less than the base density), the next printing operation is carried out without changing the cleaning conditions (step S50).

If it is judged in the step S38 that the removal of the ink by the first cleaning unit 21 is insufficient and the ink is left on the transfer surface 14*a* of the intermediate transfer body 14 and may cause adverse effects on the next print (in other words, in an unsatisfactory state where the density in the transfer image region is higher than the base density), it is then judged whether or not the number of retries is greater than a threshold value (step S40).

The following description relates to a case where the threshold value is set to "2", but the threshold value is not limited to being "2".

If the number of retries is equal to or less than the threshold value of "2", then the cleaning conditions are changed (step S42) and recleaning is carried out (step S43), or alternatively, the second cleaning is carried out (step S44), in accordance with the number of retries.

More specifically, it is judged whether or not the number of retries is equal to the threshold value "2" (step S41), and if the number of retries is less than the threshold value "2", in other words, if the number of retries is zero (the first print) or one (the first reprint), then the cleaning conditions are changed (step S42), and recleaning is carried out by the first cleaning unit 21 (step S43). Thereupon, the steps of forming a transfer image (step S32), transferring the image (step S34), cleaning (step S35), reading the transfer surface (step S36), and judging whether or not the cleaning state is satisfactory (step S38), are carried out again, and if the state is satisfactory, then the next print is carried out (step S50).

The cleaning conditions that can be changed include, for example, the cleaning pressure, the cleaning duration (or the cleaning speed), and the cleaning temperature. More specifically, it is possible to increase the cleaning pressure, to increase the cleaning duration (i.e., to reduce the cleaning speed), or to raise the cleaning temperature, or the like. By changing the cleaning conditions in this way, the cleaning efficiency is improved and therefore the transfer efficiency is improved also.

If the number of retries is equal to the threshold value, in other words, if the number of retries is two (the second reprint), then the cleaning is carried out by the second cleaning unit 22 (step S44), whereupon the steps of forming a transfer image (step S32), transferring the image (step S34), cleaning (S35), reading the transfer surface (step S36), and judging whether or not the cleaning state is satisfactory (step S38), are carried out again, and if the state is satisfactory, then the next print is carried out.

If the change of the cleaning conditions (step S42) or the second cleaning (step S44) is carried out, then it is possible to display a warning message requesting replacement of the intermediate transfer body 14, on the display unit 30. It is also possible to display a message stating "recleaning in progress", for example, on the display unit 30. Furthermore, it is also possible to display a warning message requesting maintenance of the intermediate transfer body 14 when off line, on the display unit 30.

If the number of retries has exceeded the threshold value, in other words, if the cleaning state has not become satisfactory even after changing the cleaning conditions (step S42) and performing the second cleaning (step S44), then an error message is displayed (step S46), and the printing is halted (step S48). If, for example, the number of retries is three (the third reprint), then an error message indicating incomplete cleaning is displayed on the display unit 30, and the printing is then halted.

In the above-described embodiments, the transfer condition setting unit 48 changes the transfer conditions in the image forming apparatus 10 according to the first embodiment shown in FIG. 1, and the cleaning condition setting unit 49 changes the cleaning conditions in the image forming apparatus 100 according to the second embodiment shown in FIG. 5; however, the present invention is not limited to these cases, and it is also possible to adopt a composition in which both the transfer conditions setting unit 48 and the cleaning condition setting unit 49 are provided, and the transfer conditions are changed and the cleaning conditions are changed on the basis of the state of the transfer surface 14*a* of the intermediate transfer body 14.

In the image forming apparatus 10 according to the first embodiment shown in FIG. 1, the head 12, the transfer unit 16, the transfer surface reading unit 40, and the cleaning unit 20 are disposed in the stated order in the direction of rotation R of the intermediate transfer body 14, and in the image forming apparatus 100 according to the second embodiment shown in FIG. 5, the head 12, the transfer unit 16, the cleaning unit 200, and the transfer surface reading unit 40 are disposed in the stated order in the direction of rotation R of the intermediate transfer body 14, and in both of these cases, it is possible to perform formation of the transfer image, image transfer, reading of the transfer surface and cleaning, within one rotation of the intermediate transfer body 14.

Figure 7:
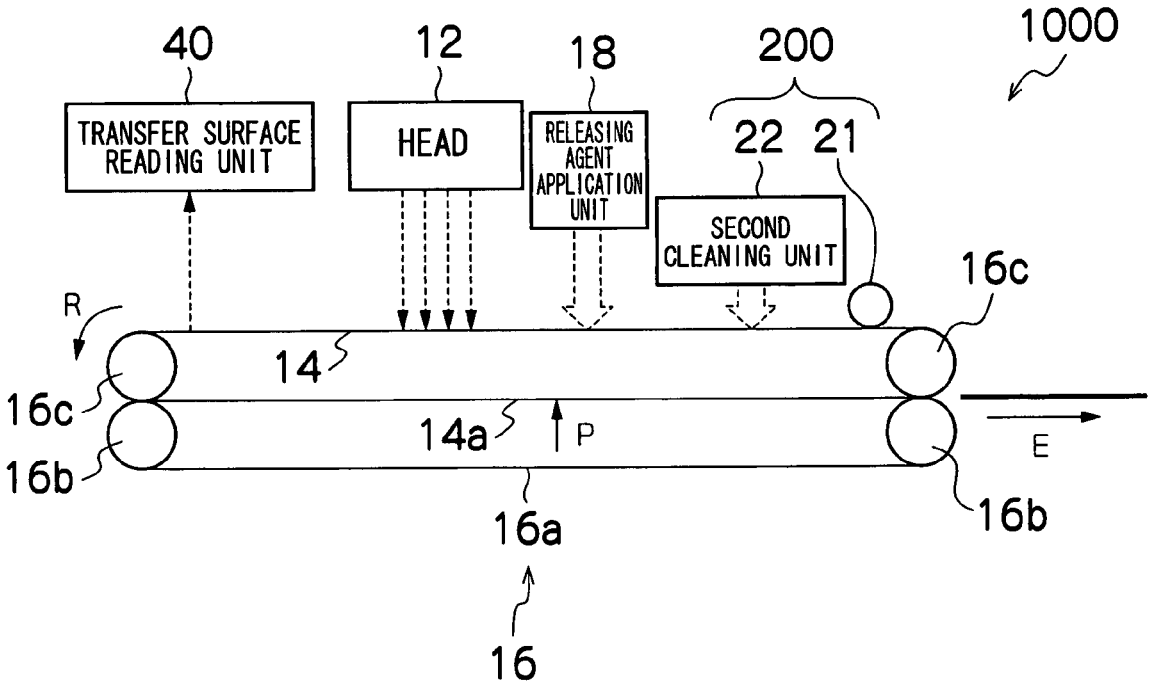
FIG. 7 is a principal schematic drawing showing an image forming apparatus in which the positional relationship of a transfer surface reading unit with respect to the head is different than the second embodiment.

FIG. 7 shows a part of an image forming apparatus 1000 according to a third embodiment of the present invention. In the image forming apparatus 1000, the head 12, the transfer surface reading unit 40, the transfer unit 16, and the cleaning unit 200 are disposed in the stated order in the direction of rotation R of the intermediate transfer body 14.

Even in the case of a positional relationship of this kind, it is possible to carry out the image forming process according to the first embodiment as illustrated in the flowchart in FIG. 4, and further, it is also possible to carry out the image forming process according to the second embodiment as illustrated in the flowchart in FIG. 6.

In the image forming apparatus 1000 shown in FIG. 7, if the image forming process according to the first embodiment shown in FIG. 4 is carried out, then the steps are carried out in the order of the transfer image formation (S2), the transfer (S4) and the transfer surface reading (S6), and therefore the intermediate transfer body 14 needs to be rotated for one additional rotation in comparison with the image forming apparatus 10 shown in FIG. 1.

Moreover, in the image forming apparatus 1000 shown in FIG. 7, if the image forming process according to the second embodiment shown in FIG. 6 is carried out, then the steps are carried out in the order of the transfer image formation (step S32), the transfer (step S34), the cleaning (step S35) and the transfer surface reading (step S36), and therefore the intermediate transfer body 14 needs to be rotated for one additional rotation in comparison with the image forming apparatus 100 shown in FIG. 5.

The image forming apparatus 1000 shown in FIG. 7 is not able to carry out the cleaning during the first rotation, and therefore control is implemented in such a manner that the cleaning unit 200 is separated from the intermediate transfer body 14 during the first rotation, or alternatively, the cleaning conditions are set in the cleaning unit 200 in such a manner that the cleaning is not substantially carried out (for instance, by reducing the cleaning pressure or the cleaning temperature).

The image forming apparatus 1000 in FIG. 7 has lower productivity than the image forming apparatus 10 shown in FIG. 1 and the image forming apparatus 100 shown in FIG. 5, in accordance with the increase in the number of rotations of the intermediate transfer body 14, but on the other hand, it is able to achieve the beneficial effects of the present invention in terms of preventing the effects on the next print caused by residual ink.

In the above-described embodiments, the intermediate transfer body is constituted of the endless belt; however, the intermediate transfer body of the present invention is not limited to the belt, and the present invention can be applied similarly provided that the intermediate transfer body is constituted of a body that can be repeatedly used. For example, the intermediate transfer body may be a cylindrical body (a drum), or another rotational body.

Figure 8A:
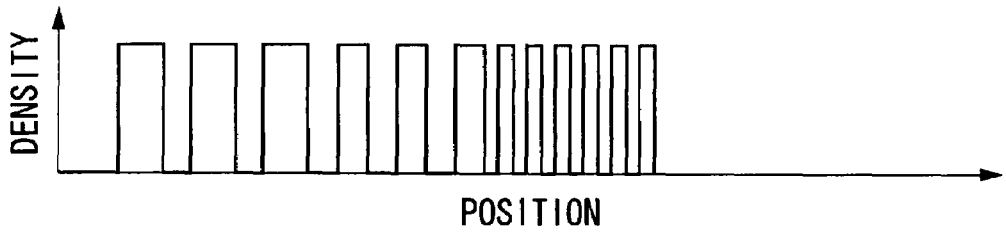
FIGS. 8A to 8C are illustrative drawings used to describe a mode of judging the state of the transfer surface on the basis of a correlation between image data used to form a transfer image and read image data.
Figure 8B:
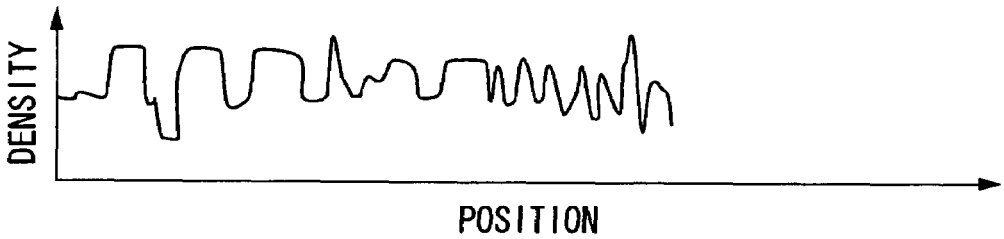
Figure 8C:
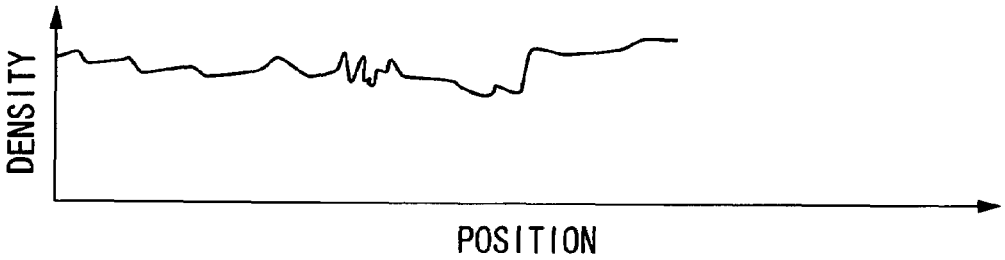

In the above-described embodiments, the densities of the colors in the read image obtained by the transfer surface read unit 40 are compared with the base density that has been beforehand stored in the storage unit 32 for judging the state of the transfer surface 14*a* of the intermediate transfer body 14 (the transfer state and the cleaning state) by means of the transfer body state judgment unit 46; however, the present invention is not limited in particular to a case of this kind, and it is also possible to judge the state of the transfer surface 14*a* of the intermediate transfer body 14 on the basis of a correlation between the image data used in the formation of the transfer image and the read image data. More specifically, at first, an image pattern is printed that changes in accordance with the pixel alignment direction of the reading elements constituting the transfer surface read unit 40. For example, the pattern includes a plurality of cyclical patch patterns, or random image patterns (including many different frequency components). Next, the correlation coefficient ρ between A(x) and B(x) is determined, where A(x) is the density profile A(x) shown in FIG. 8A, which is beforehand calculated from the image data constituting these image patterns, and B(x) is the density profile B(x) shown in FIG. 8B or 8C, which is obtained by reading in the transfer surface 14*a* of the intermediate transfer body 14 after the transfer, and by comparing this correlation coefficient ρ with a threshold value beforehand stored in the storage unit 32, the state of the transfer surface 14*a* of the intermediate transfer body 14 is judged. FIG. 8B shows B(x) of which the correlation with A(x) is large, and FIG. 8C shows B(x) of which the correlation with A(x) is small.

In the above-described embodiment, the image pattern printed for judging the state of the transfer body is different to the image printed when the image forming apparatus 10 is in operation; however, the present invention is not limited in particular to a case of this kind, and it is also possible to compare the density profile A(x) calculated on the basis of the image data used for printing when the image forming apparatus 10 is actually in operation, and the density profile B(x) calculated on the basis of the read image data of the transfer surface 14*a* of the intermediate transfer body 14 after the transfer.

As described above, in the case of a mode where the densities of the colors of the read image are compared with the base densities beforehand stored in the storage unit 32, the judgment of the transfer abnormalities (the residual ink) is made by firstly measuring the density of the transfer surface 14*a* of the intermediate transfer body 14 after the transfer, and then comparing this density with the base density of the transfer surface 14*a* of the intermediate transfer body 14 beforehand stored in the storage unit 32, and judging the transfer abnormality to have occurred if the read out color density is higher than the base density. It is possible to envisage undesirable circumstances where the density of the color of the transfer surface 14*a* of the intermediate transfer body 14 is not uniform over the whole of the transfer surface, or where there are small density non-uniformities that create noise, or the like. Consequently, there may be cases where judgment cannot be performed correctly, simply on the basis of a comparison with a previously stored base density. Hence, a desirable mode is one in which an image pattern is printed, the correlation coefficient between the image pattern used for the printing and the image pattern read in after the transfer is determined, and if the correlation coefficient is equal to or less than a threshold value (if there is little or no correlation between the read image data after the transfer and the image data used for the printing), then it is judged that there is no residual ink, whereas if the correlation coefficient is greater than the threshold value (if the pattern of the image data used for the printing appears in the pattern of the read image data), then it is judged that there is residual ink.

Moreover, it is also possible to change the output conveyance path of the transfer-receiving medium 80 on the basis of the result of reading the transfer surface 14*a* of the intermediate transfer body 14 after the transfer.

Furthermore, in addition to being used for the determination of abnormalities on the intermediate transfer body 14, the transfer surface reading unit 40 may also be used to determine ejection failures in the head 12, droplet ejection fluctuations (variations in the droplet deposition position, droplet ejection size, or the like), fluctuation in the driving of the intermediate transfer body 14, variations in conveyance (such as skew, speed fluctuation, or the like), and so on.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a head which ejects ink droplets;

an intermediate transfer body having a transfer surface on which a transfer image is formed by means of the ink droplets ejected from the head;

a transfer device which performs a transfer of the transfer image formed on the transfer surface of the intermediate transfer body to a prescribed transfer-receiving medium;

an intermediate transfer body movement device which moves the intermediate transfer body to circulate the transfer surface through a first path from a first position facing the head to a second position facing the transfer device and a second path from the second position to the first position, the second path being different than the first path;

a transfer surface reading device which is arranged to face the transfer surface at a third position in the second path between the second position and the first position, and obtains read image data by reading in the transfer surface of the intermediate transfer body after the transfer of the transfer image and before another transfer image is formed on the transfer surface;

a judgment device which performs judgment of a transfer state of the transfer surface of the intermediate transfer body in accordance with the read image data obtained by the transfer surface reading device; and a transfer condition changing device which changes a transfer condition of the transfer device in accordance with the judgment of the judgment device.

2. The image forming apparatus as defined in claim 1, wherein the transfer condition changed by the transfer condition changing device includes at least one of: a pressure with which the transfer-receiving medium is pressed against the transfer surface of the intermediate transfer body by the transfer device, duration during which the transfer-receiving medium is pressed against the transfer surface of the intermediate transfer body by the transfer device, and a temperature during the transfer performed by the transfer device.

3. The image forming apparatus as defined in claim 1, wherein the judgment device performs the judgment of the transfer state of the transfer surface of the intermediate transfer body in accordance with a correlation between image data used for image formation onto the transfer surface of the intermediate transfer body by the head, and the read image data obtained by the transfer surface reading device.

4. An image forming apparatus, comprising:

a head which ejects ink droplets;

an intermediate transfer body having a transfer surface on which a transfer image is formed by means of the ink droplets ejected from the head;

a transfer device which performs a transfer of the transfer image formed on the transfer surface of the intermediate transfer body to a prescribed transfer-receiving medium;

a cleaning device which performs cleaning of the transfer surface of the intermediate transfer body after the transfer;

an intermediate transfer body movement device which moves the intermediate transfer body to circulate the transfer surface through a first path from a first position facing the head via a second position facing the transfer device to a third position facing the cleaning device and a second path from the third position to the first position, the second path being different than the first path;

a transfer surface reading device which is arranged to face the transfer surface at a fourth position in the second path between the third position and the first position, and obtains read image data by reading in the transfer surface of the intermediate transfer body after the cleaning and before another transfer image is formed on the transfer surface;

a judgment device which performs judgment of a cleaning state of the transfer surface of the intermediate transfer body in accordance with the read image data obtained by the transfer surface reading device; and a cleaning condition changing device which changes a cleaning condition of the cleaning device in accordance with the judgment of the judgment device.

5. The image forming apparatus as defined in claim 4, wherein the cleaning condition changed by the cleaning condition changing device includes at least one of: a pressure with which the cleaning device is pressed against the transfer surface of the intermediate transfer body, duration of the cleaning performed by the cleaning device, and a temperature during the cleaning performed by the cleaning device.

6. The image forming apparatus as defined in claim 4, wherein the judgment device performs the judgment of the cleaning state of the transfer surface of the intermediate transfer body in accordance with a correlation between image data used for image formation onto the transfer surface of the intermediate transfer body by the head, and the read image data obtained by the transfer surface reading device.

7. An image forming method, comprising:

a transfer image forming step of forming a transfer image on a prescribed transfer surface by depositing ink droplets onto the transfer surface;

a transfer step of transferring the transfer image formed on the transfer surface to a prescribed transfer-receiving medium;

a transfer surface reading step of obtaining read image data by reading in the transfer surface after the transfer image has been transferred in the transfer step and before another transfer image is formed on the transfer surface in the transfer image forming step;

a judgment step of performing judgment of a transfer state of the transfer surface in accordance with the read image data obtained in the transfer surface reading step; and a transfer condition changing step of changing a transfer condition in the transfer step in accordance with the judgment in the judgment step.

8. The image forming method as defined in claim 7, wherein the transfer condition changed in the transfer condition changing step includes at least one of: a pressure with which the transfer-receiving medium is pressed against the transfer surface in the transfer step, duration during which the transfer-receiving medium is pressed against the transfer surface in the transfer step, and a temperature during the transfer in the transfer step.

9. The image forming method as defined in claim 7, wherein the judgment in the judgment step is performed in accordance with a correlation between image data used for forming the transfer image in the transfer image forming step, and the read image obtained in the transfer surface reading step.

10. An image forming method, comprising:

a transfer image forming step of forming a transfer image on a prescribed transfer surface by depositing ink droplets onto the transfer surface;

a transfer step of transferring the transfer image formed on the transfer surface to a prescribed transfer-receiving medium;

a cleaning step of cleaning the transfer surface after the transfer step;

a transfer surface reading step of obtaining read image data by reading in the transfer surface after the cleaning step and before another transfer image is formed on the transfer surface in the transfer image forming step;

a judgment step of performing judgment of a cleaning state of the transfer surface in accordance with the read image data obtained in the transfer surface reading step; and a cleaning condition changing step of changing a cleaning condition in the cleaning step in accordance with the judgment in the judgment step.

11. The image forming method as defined in claim 10, wherein the cleaning condition changed in the cleaning condition changing step includes at least one of: a pressure with which a cleaning unit that cleans the transfer surface is pressed against the transfer surface in the cleaning step, duration of the cleaning in the cleaning step, and a temperature during the cleaning in the cleaning step.

12. The image forming method as defined in claim 10, wherein the judgment in the judgment step is performed in accordance with a correlation between image data used for forming the transfer image in the transfer image forming step, and the read image obtained in the transfer surface reading step.

* * * * *